United States Patent [19]

Stoute, Sr. et al.

[11] 4,296,506

[45] Oct. 27, 1981

[54] INVALID CHAIR

[75] Inventors: Neville Stoute, Sr., New York, N.Y.; Robert J. Pennise, Colmar, Pa.

[73] Assignees: James A. Falborn; Richard M. Bird, both of New York, N.Y. ; part interest to each

[21] Appl. No.: 126,147

[22] Filed: Feb. 29, 1980

Related U.S. Application Data

[63] Continuation-in-part of Ser. No. 99,187, Nov. 30, 1979, abandoned.

[51] Int. Cl.[3] ..... A47K 11/06; A61G 7/02; A47K 11/04

[52] U.S. Cl. ..... 4/480; 4/479; 4/478; 4/452

[58] Field of Search ..... 4/480, 473, 478, 479, 4/451, 452

[56] References Cited

U.S. PATENT DOCUMENTS

| | | | |
|---|---|---|---|
| 341,135 | 5/1886 | Ellison | 4/478 |
| 557,614 | 4/1896 | Schmitt | 4/480 |
| 902,737 | 11/1908 | Jones | 4/478 X |
| 1,691,620 | 11/1928 | Wilson | 4/480 |
| 3,245,090 | 4/1966 | Slimmer | 4/478 |
| 3,271,785 | 9/1966 | Du Bose | 4/480 |
| 3,568,219 | 3/1971 | Roberts | 4/483 |

*Primary Examiner*—Henry K. Artis
*Attorney, Agent, or Firm*—Ladas & Parry

[57] ABSTRACT

A seat for a collapsible invalid wheelchair comprising: a flexible padded seat; an elongated, generally rectangular opening in the seat; reinforcing means located within the seat and at the underside of the seat respectively on either side of the said opening; flanges on the underside of the seat; a removable waste-receiving receptacle sliding in said flanges and extending over the full length of said opening; and a detachable flexible padded flap adapted to close said opening after the receptacle has been removed; the arrangement being such that the removal and closing of the flap, and the insertion and removal of the receptacle can all be accomplished by the chair occupant without leaving the chair.

14 Claims, 8 Drawing Figures

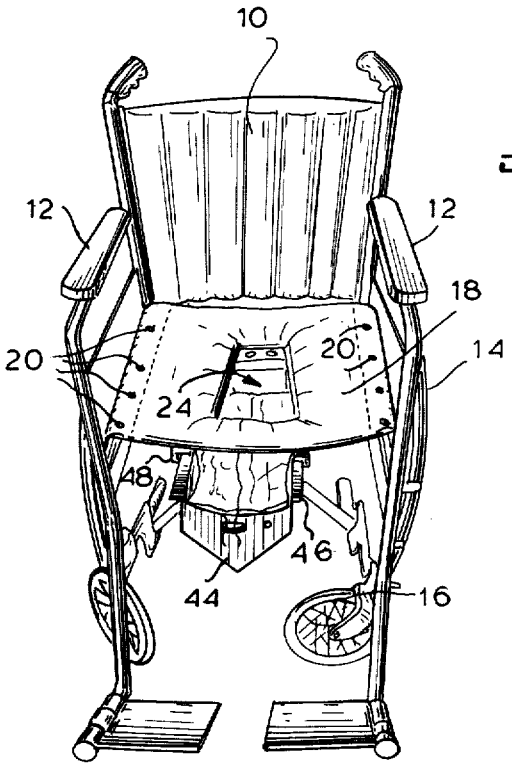
Fig. 1
Fig. 3
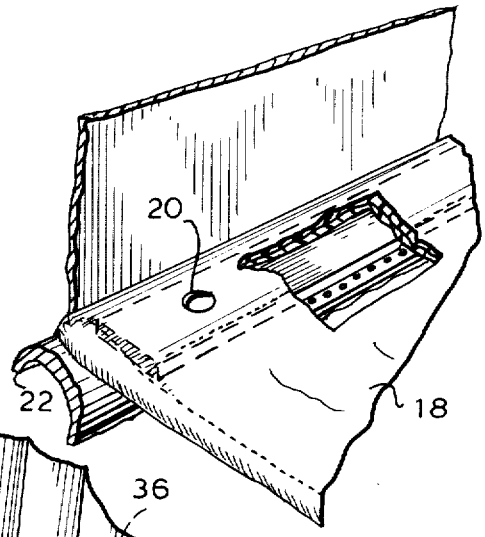
Fig. 2
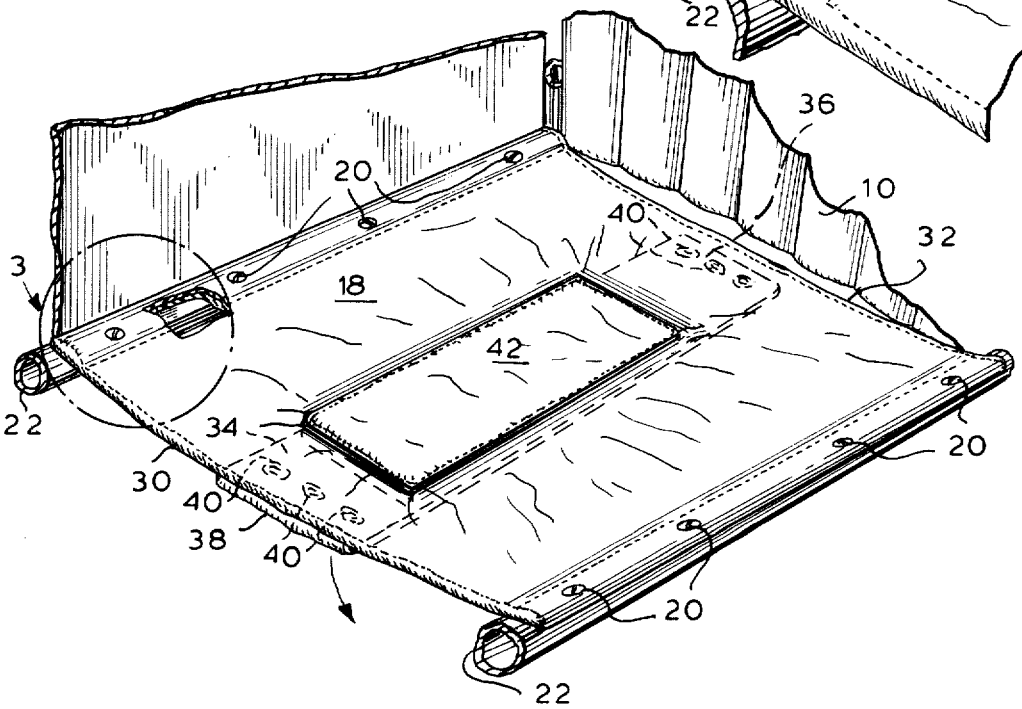

INVALID CHAIR

This application is a continuation-in-part of our application Ser. No. 099187 filed Nov. 30, 1979 which has now been abandoned.

This invention relates to a seat for a collapsible invalid wheelchair which enables the wheelchair to be readily converted into a commode by the occupant of the chair.

Invalids and old-age inmates of nursing homes generally lack adequate nursing care and are continuously plagued by the problem of attending to their own bodily needs without help. It is accordingly the principal object of the invention to provide an improved wheelchair seat structure which the occupant need not leave when he or she is urged to visit the toilet.

Our seat provides a means whereby senile persons can relieve themselves almost spontaneously and still be spared the shame and indignity of prolong skin contact with the body waste materials.

The seat may also be utilized from the rear by someone assisting the invalid, for the receptacle can be inserted and withdrawn from the front or rear with equal facility. The invalid may not be mentally aware of his or her bodily needs in order to benefit from the seat's function for it is not necessary that the invalid be moved from his seated position to eliminate the body waste material.

SCHWINN's U.S. Pat. No. 2,880,783 (1959) is concerned with a similar problem. In SCHWINN the wheelchair seat is in the form of a U-shaped wooden platform. A sliding panel closes the opening in the "U". The panel is supported on rollers so that it can slide back to a raised position.

A conventional commode is shown in BEALL's U.S. Pat. No. 601,312 (1898). In BEALL, guide rails or tracks are secured to the underside of the seat and a pan with projecting flanges is suspended from guide rails. A flat lid or plate fits over the pan to prevent the escape of noxious fumes during removal of the pan for the purpose of emptying it.

A fixed form of commode is disclosed in AGNEW et al U.S. Pat. No. 3,863,276. A padded seat has an elongated aperture between front and rear. Provision is made for a waste-receiving vessel and associated lid. The vessel is located below the aperture and is adapted to slide with its side members over flanges located on the commode frame.

BRIEF SUMMARY OF THE INVENTION

According to the invention, we provide a seat for a collapsible invalid wheelchair comprising:

- a flexible padded seat;
- an generally rectangular opening in the seat;
- reinforced means located within the seat and at the underside of the seat respectively on either side of the said opening;
- flanges on the underside of the seat;
- a removable waste-receiving receptacle sliding in said flanges and extending over the full length of said opening; and
- a detachable flexible padded flap adapted to close said opening after the receptacle has been removed;
- the arrangement being such that the removal and closing of the flap, and the insertion and removal of the receptacle can all be accomplished by the chair occupant without leaving the chair.

The invention will now be described in greater detail with reference to the drawings.

BRIEF DESCRIPTION OF THE DRAWINGS

FIG. 1 shows a front perspective view from above of a collapsible invalid wheelchair provided with the improved seat of the invention;

FIG. 2 shows a perspective view of the padded seat from above with standard parts of the chair broken away;

FIG. 3 shows in an enlarged detail view the manner in which the side of the seat is mounted;

DETAILED DESCRIPTION

Figure 4:
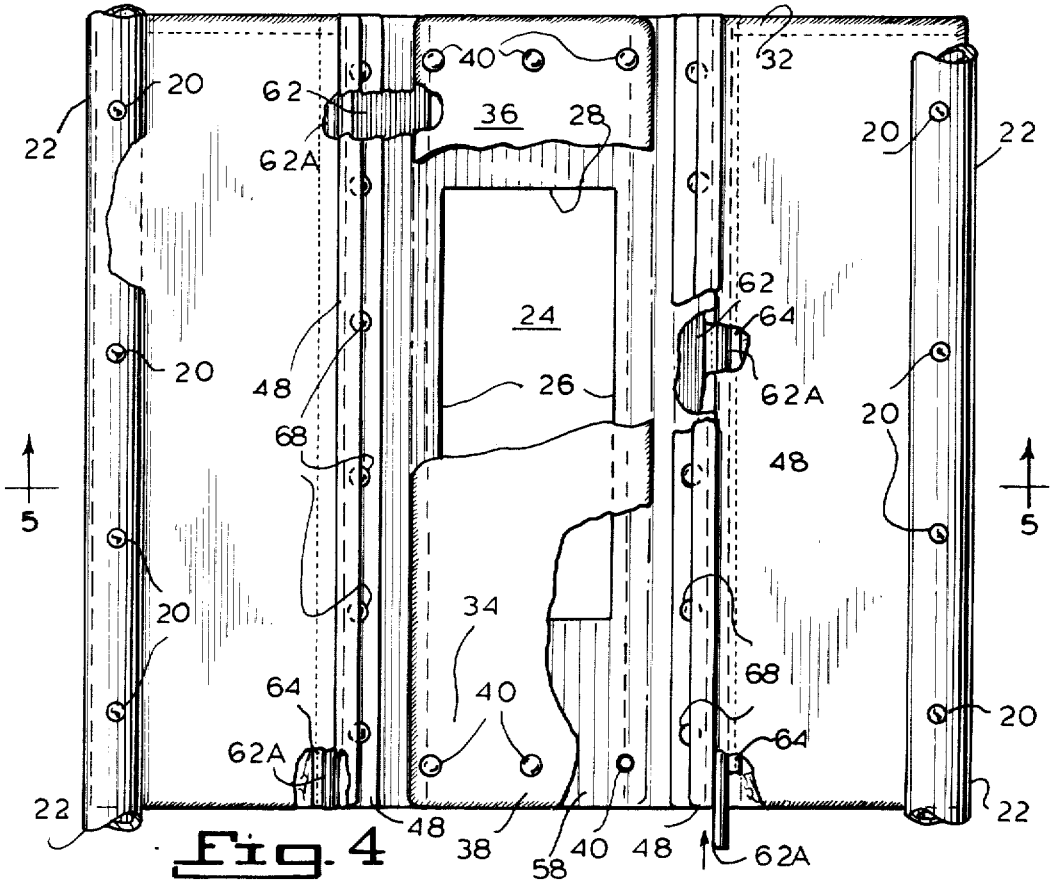
FIG. 4 shows a plan view of the seat from underneath with parts of the flap broken away.

Referring to the drawings, FIG. 1 shows a conventional invalid wheelchair having a padded back 10, arms rests 12, large hand-operated ground wheels 14 and smaller pivoted wheels 16.

The padded seat 18 is laterally secured by screw bolts or studs 20 to tubular horizontal side members or bars 22 extending in the fore-aft direction of the chair. The padded seat is in this manner semipermanently attached to the metal frame of the chair. The detachable nature of the screw bolts 20 permits of ready replacement of the seat 18 when it is worn out, this being the part of the chair which is subjected to greatest wear.

The padded seat 18 is centrally formed with an elongated generally rectangular opening 24. The longer sides 26 of this opening extend parallel to side bars 22. The configuration of opening 24 is best seen in FIG. 4. The narrow sides 28 are located at some distance from the front and rear edges 30, 32 of the seat. In this way, solid areas 34, 36 are left between said front and rear edges 30, 32 and the elongated opening 24. It is in these areas 34, 36 that the flap 38 is attached to the seat 18 from underneath.

The flap 38 is attached by means of press studs 40 to the seat. Three of these studs 40 can be seen in FIG. 4 at either end of the opening. The middle of the three press studs at the front is attachable to the middle of the three studs at the rear so that the flap can be folded in half and secured, and thus does not hang down from the seat to its full length.

The padded flap 38 is shown in closed position in FIG. 2. The flap 38 has a raised central padded area 42 which is roughly of double thickness. Raised area 42 fits into and completely fills the elongated opening 24. The thickness of the raised area above the thinner end portions of the flap is equal to the thickness of the padded seat so that in the FIG. 2 closed position, the upper surface of flap 42 is flush with seat 18 so as not to give the seat occupant any discomfort.

As the ends of the flap extend up to the front and rear edges 30, 32, of the seat, the front (or rear) of the flap can be easily grasped by the seat occupant and the press stud connection at either or both ends can be readily detached by a jerky hand movement. When either end of the flap 38 is detached, the flap acts as a stop for the receptacle 44 at the opposite end of the runner 48.

In use, the flap 38 is preferably detached at the front, the occupant first having removed the receptacle 44. The receptacle is then replaced and the occupant is free to use the facilities. The flap 38 can also be detached at the rear by an assistant without conscious cooperation from the seat occupant.

Figure 6:
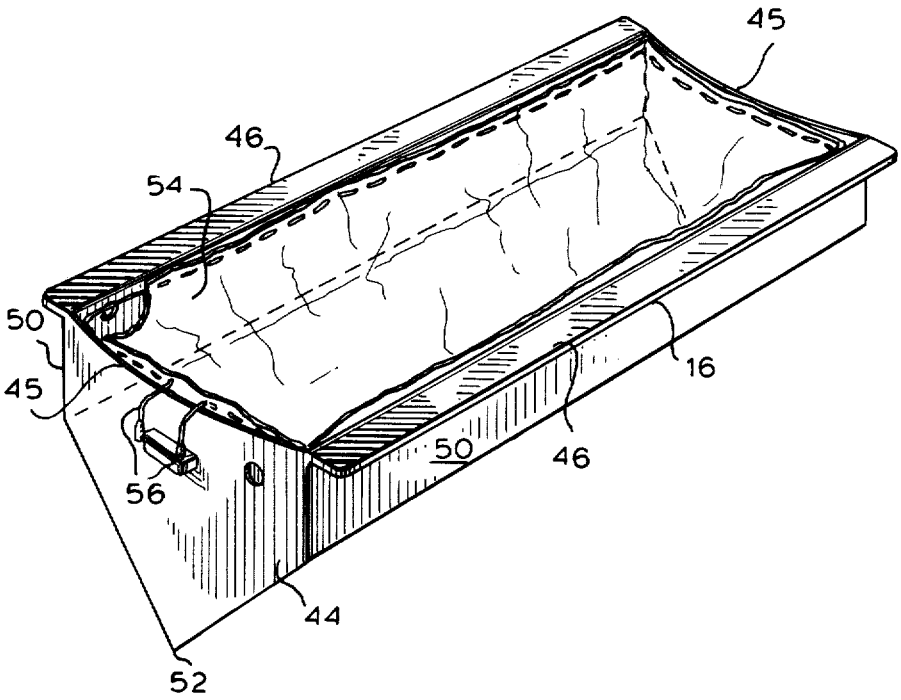
FIG. 6 shows the receptacle and plastic bag in perspective.

The receptacle 44 is shown by itself in FIG. 6. It is generally boat-shaped with side flanges 46 extending the full length of the receptacle. These side flanges 46 are held in L-shaped runners 48 bolted or press-snapped for easy removal and cleaning against the underside of the padded seat 18, see FIG. 7. The runner channels 48 can be easily snapped on or off for sanitary maintenance.

In the preferred form of the invention the receptacle 44 has straight sides 50 roughly equal in width to half the full depth of the receptacle. The bottom of the receptacle is generally triangular in section ending in a ridge 52. The receptacle in this manner makes best use of the space available between the underside of the seat and the standard pivoted cross bars of the chair frame. The modified seat of the invention thus can be fitted on existing frames which do not require modification. The conventional cross bars of invalid chairs are articulated at a point immediately below bottom ridge 52 of the receptacle and as is well known in the art, existing chairs with this articulated structure can be readily folded and stored away.

The receptacle is preferably made from ⅛ inch or thinner plastic material so that it can be readily washed and sterilized. The receptacle is "V" shaped at its bottom and designed to clear the wheelchair cross bars when in use or when "stored" on runner channels below "closed" window cover flap 38. The receptacle 44 has a concave edge 45 at the top of both front and rear to allow for the curvature of the seat caused by the invalid's body weight. The flanges 46 of the receptacle are fairly flexible and have a slight upward tilt so that the runner channels 48 will accommodate the receptacle with no problem. The width of the receptacle against the channels hold it firmly in place. There is a small hole at the front of the receptacle near the top. This is so that the provided "S" hook can be used to hang the receptacle on the back of the chair when the chair is collapsed. The receptacle is lined near the top of both of its inner sides with three small plastic snaps that fit corresponding snaps on the disposable plastic pouch to hold the pouch in proper place for efficient use. The "V" shaped depth of the receptacle is arbitrary and may be altered at the discretion of the designer. A plastic bag lining 54 is placed in the receptacle prior to use so that the waste matter actually does not come into contact with the inner sides of the receptacle. A suitable deodorant in liquid or powder form can be placed in the receptacle or plastic pouch.

The disposable plastic bag lining or pouch is designed with small plastic snaps positioned near upper outside edges to hold it in place at sides of receptacle when receptacle is in place awaiting use. Snaps are stationed at locations alongside of receptacle for easy drawstring closing and removal of the pouch which is easily disposable.

A pull-string 56 runs round the edge of the liner.

Figure 8:
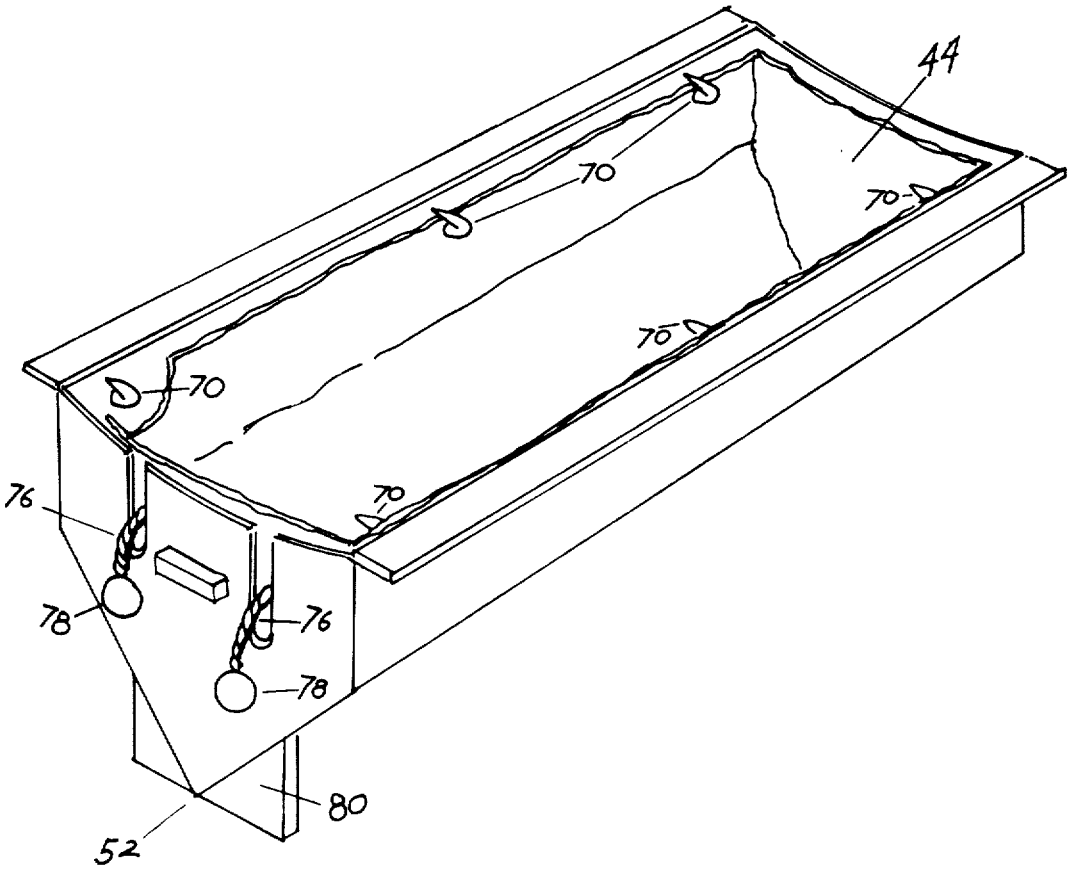
FIG. 8 shows a modified version of the receptacle and plastic bag.

In the modification shown in FIG. 8, the plastic snaps at the top of the receptacle 44' are replaced on each side by three hooks 70 set at a 45 degree angle to the top edge of the receptacle. Instead of being provided with plastic snaps, the plastic bag 54' has three small openings 72 near its upper long edges, these holes fitting over hooks 70.

The front face 44' of the receptacle has two vertical slots 74. The ends of the pull-strings 76 project through slots 74 and carry knobs 78 which are too large to be drawn back through the slots.

The chair occupant by grasping the pull-strings 76 at the knobs 78 and by pulling the strings forward will cause the top of the plastic bag to be closed and at the same time pulled off the forwardly inclined hooks 70.

A triangular foot stand 80 is attached to the receptacle on either side of the lower ridge 52 formed by the triangular bottom. In this way, the receptacle is prevented from tipping over after it has been removed from the seat.

After the occupant has finished, he or she can pull the drawstrings on the liner, closing the bag against the inside wall between the two slots at the front of the receptacle. The occupant can then slide out the receptacle from under the seat, remove the bag, and drop it into a suitable bin. Ordinarily the removal of the waste matter should be complete, but if the receptacle should get soiled it can be fairly readily cleaned under tap of running water. All of these operations are simple and could be accomplished without assistance by a chair occupant handicapped by old age or some other infirmity.

Figure 7:
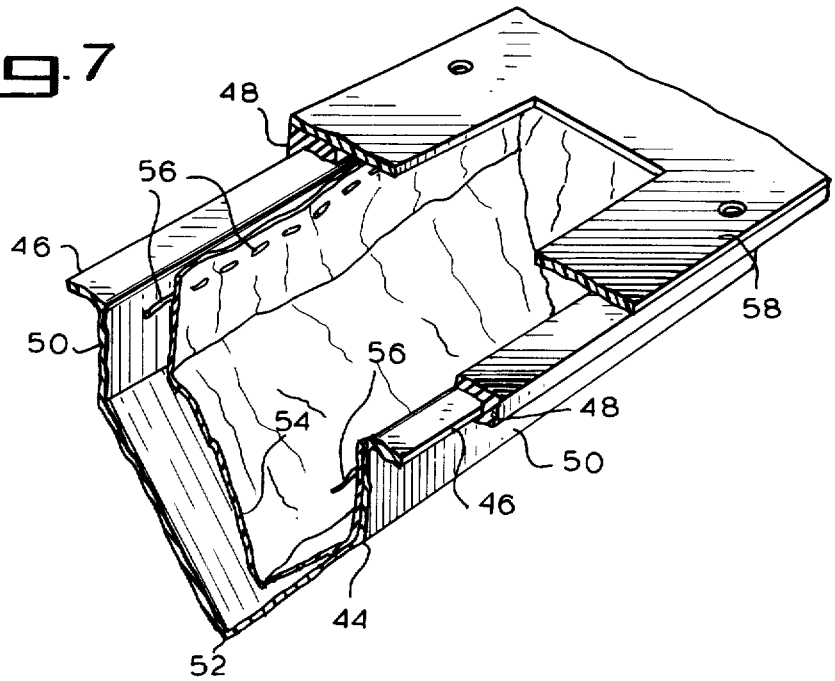
FIG. 7 shows in a similar fragmented view the manner in which the receptacle is mounted in the slides underneath the seat.

As clearly shown in FIG. 7, the L-shaped runners 48 are directly or with the interposition of another flexible plastic plate 60 bolted or riveted, or press-snapped to the underside of the padded seat. The plastic plate 60 protects the underside of the seat from any splash that may occur and it is easily wiped clean.

Figure 5:
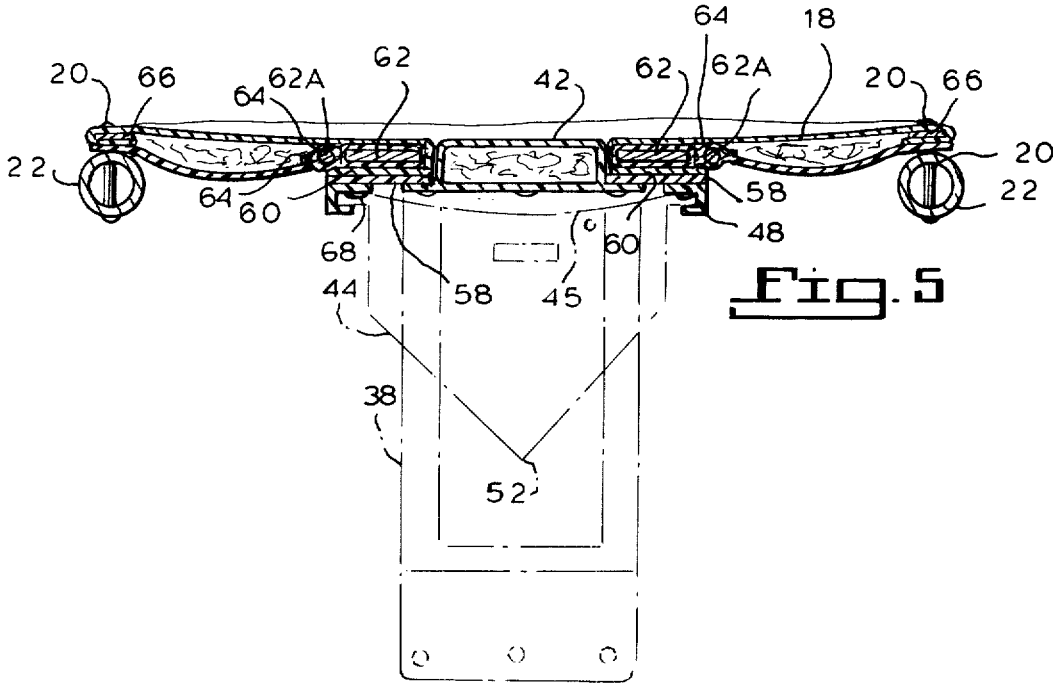
FIG. 5 shows a cross-sectional view of the seat taken on line 5—5 in FIG. 4.

The runners 48, and plates 58, 60 are made from plastic material or stainless steel. To prevent fracture of the runners 48 under the weight of the chair occupant, the seat assembly is stiffened by the provision of reinforcing means in the form of flat longitudinal steel bars 62 in between canvas layers and directly above runners 48, and tubes 62A in stitched pockets 54 running lengthwise of the seat at the outer sides of the runners 48. These bars 62 can be seen in the section of FIG. 5 and parts of one of the tubes can be seen in broken away portions of FIG. 4.

The pockets 64 are the same length as the steel tubes 62A and are open at both ends so that the body weight pressure does not cause the tubes 62A to break through the ends of the pockets. The pocket material thus simply "rides down" in unison with the tubes. The tight fit of the pocket covers hold the tubes securely in place.

The padded seat and the padded flap are made from a suitable plastic such as the material known under the trademark "NAUGAHYDE", or canvas lined vinyl could be used. The padded seat 18 could be made from a single sheet of "NAUGAHYDE" folded along edge 30 and heat-sealed or stitched along the rear edge 32. Both the seat and the flap are padded with 2 inch foam rubber or silicone. The top layer of the seat material can be covered with synthetic sheep-skin like material which is easily washable. This material can be removably attached using "VELCRO" type fasteners.

At the sides where the padded seat 18 is secured to tubular side member 22 1/16 inch aluminum of steel reinforcement bars 66 (1 inch wide) may be provided. Holes are drilled at arbitrary intervals for seat attachment screw bolts 20 so that any wheelchair may be fitted. Aluminum bars 66 strengthen "NAUGA- HYDE", the seat material, along its left and right edges where the padded seat is screwed to the wheelchair frame tubes. The top "NAUGAHYDE" layer and the middle layers are wound once around aluminum reinforcement bars 66 when the screw bolts 20 are inserted.

A heat-sealing process or thread stitches seal all layers of the seat consisting of upper and lower "NAUGAHYDE", and two 12 oz. canvas middle layers together around the four sides of the seat's elongated opening or window 24.

Thread stitches close all layers at the rear of seat or a heat-sealing process may be substituted.

The four sides of the elongated opening or window 24 are sealed by U-shaped channels made of moderately rigid vinyl. These channels border the space on all four sides of the window which permits body waste materials to fall through seat into the disposable plastic pouch 54 stationed within plastic receptacle 44.

The L-shaped runners 48 are in the form of ⅛ inch plastic channels 48 attached to underside of lower plate 58 with metal snaps 68 through stainless steel metal facing (1/32 inch) at the upper side of lower plate 58. These runners 48 accommodate the plastic receptacle with its disposable pouch that collects the body wastes. Runner channels 48 run from front to rear and the receptacle may be guided in and out from the front or the rear of the seat. The runners 48 can be easily snapped on or off for sanitary maintenance.

The two bars 62 are preferably 15¼ inch long, 2 inches wide, and 3/16 inches thick. They are positioned directly above the runner channels 48. These bars support the body weight of the chair occupant so that the runner channels 48 remain straight and in cohesion with their fasteners 68. The bars 62 are placed between the two middle layers of canvas.

The two tubes (62A) are both parallel and adjacent to the runner channels 48 and they are stainless steel. They are ⅜ inch diameter stainless steel round tubes and they are 15 inches long.

They are stitched to the underside of the seat with "NAUGAHYDE" or rubber tube covers or "pockets" 64. Because tubes are very difficult to bend, the reinforcement of these tubes 62A in conjunction with the rigidity of the steel bars 62 assure that the body weight of a large individual will not fracture the runner channels 48.

What we claim is:

1. A replacement seat for a collapsible invalid wheelchair which comprises a left side frame member, a right side frame member and means effective between the frame members to hold them apart, said seat comprising:

a flexible padded seat member having a left side edge and right side edge for attachment to the left side frame member and the right side frame member respectively of an existing collapsible wheelchair, said seat member being formed with an elongated, generally rectangular opening extending substantially parallel to the left and right side edges of the seat member, reinforcing means located within the seat member and at the underside of the seat member respectively on each side of said opening;

means defining tracks on the underside of the seat member and extending substantially parallel to the left and right side edges of the seat member on each side of the opening;

a removable receptable adapted to fit slidingly in said tracks and extend over the full length of said opening; and a detachable flexible padded flap removably attached to the seat member at the underside thereof for closing said opening after the receptacle has been removed, the arrangement being such that the removal and attachment of the flap, and the insertion and removal of the receptacle can all be accomplished from the underside of the seat member, and such that upon removal of the receptacle the seat member can be folded about a line extending substantially parallel to the left and right side edges of the seat member without interference from the reinforcing means or the track defining means.

2. The seat for an invalid wheelchair as claimed in claim 1, wherein the reinforcing means are in the form of bars and tubes and the bars are located between canvas layers and the tubes are located in open pockets running along the sides of the elongated opening at the bottom of the seat member.

3. The seat for an invalid wheelchair as claimed in claim 1, wherein the flexible flap is detachably secured to the seat member from underneath by means of press studs and the flap has a raised central padded area of double thickness which fits into and completely fills the elongated rectangular opening in the seat member.

4. The seat for an invalid wheelchair as claimed in claim 1, wherein the removable receptacle is generally boat-shaped and has side flanges for fitting in said tracks.

5. The seat for an invalid wheelchair as claimed in claim 1, wherein said means defining tracks comprise L-shaped runners bolted or press-snapped against the underside of the seat member.

6. The seat for an invalid wheelchair as claimed in claim 1, wherein the receptacle is v-shaped and is lined with a disposable plastic pouch.

7. The seat for an invalid wheelchair as claimed in claim 6, wherein the receptacle has a concave edge at the top of the front and rear edge to allow for curvature of the seat member.

8. A collapsible invalid wheelchair comprising:

a left side frame member;

a right side frame member;

collapsible means effective between the right side frame member and the left side frame member and having an uncollapsed condition in which said frame members are held apart and a collapsed condition in which said members can be moved together, and a flexible padded seat having a left side edge and a right side edge attached to the left side frame member and the right side frame member respectively; said seat being formed with an elongated, generally rectangular opening extending in the direction from front to rear of the seat, and said seat including reinforcing means located within the seat and at the underside of the seat respectively on each side of said opening, means defining tracks on the underside of the seat and extending from the front to the rear of the seat on each side of the opening, a removable receptacle adapted to fit slidingly in said tracks and extend over the full length of said opening; and a detachable flexible padded flap removably attached to the seat at the underside thereof for closing said opening after the receptacle has been removed, the arrangement being such that the removal and attachment of the flap, and the insertion and removal of the receptacle can all be accomplished by the chair occupant without leaving the chair, and such that, upon removal of the receptacle, the chair and seat can be folded without interference from the reinforcing means or the track defining means and without detaching the seat from the frame members.

9. The invalid wheelchair as claimed in claim 8, wherein the reinforcing means are in the form of bars and tubes and the bars are located between canvas layers and the tubes are located in open pockets running along the sides of the elongated opening at the bottom of the seat.

10. The invalid wheelchair as claimed in claim 8, wherein the flexible flap is detachably secured to the seat from underneath by means of press studs and the flap has a raised central padded area of double thickness which fits into and completely fills the elongated rectangular opening in the seat.

11. The invalid wheelchair as claimed in claim 8, wherein the removable receptacle is generally boat-shaped and has side flanges for fitting in said tracks.

12. The invalid wheelchair as claimed in claim 8, wherein said means defining tracks comprise L-shaped runners bolted or press-snapped against the underside of the seat.

13. The invalid wheelchair as claimed in claim 8, wherein the receptacle is V-shaoed and is lined with a disposable plastic pouch.

14. The invalid wheelchair as claimed in claim 13, wherein the receptacle has a concave edge at the top of the front and rear edge to allow for curvature of the seat.

* * * * *

UNITED STATES PATENT AND TRADEMARK OFFICE

CERTIFICATE OF CORRECTION

PATENT NO. : 4,296,506

DATED : October 27, 1981

INVENTOR(S) : Neville Stoute, Sr., et al

It is certified that error appears in the above-identified patent and that said Letters Patent is hereby corrected as shown below:

Column 6, lines 22 - 27 should read as follows:

--3. The seat for an invalid wheelchair as claimed in claim 1, wherein the flexible flap is detachably secured to the seat member from underneath by means of press studs or VELCRO and the flap has a raised central padded area of double thickness which fits into and completely fills the elongated rectangular opening in the seat member.--.

Signed and Sealed this

Eighteenth Day of March, 1997

*Attest:*

*Attesting Officer*

BRUCE LEHMAN

*Commissioner of Patents and Trademarks*